US006986515B2

(12) United States Patent
Hyduk

(10) Patent No.: US 6,986,515 B2
(45) Date of Patent: Jan. 17, 2006

(54) INTERACTIVE EXCHANGE QUALIFICATION GAME

(76) Inventor: Michael Hyduk, 37 Aster Ct., Belle Mead, NJ (US) 08502

( * ) Notice: Subject to any disclaimer, the term of this patent is extended or adjusted under 35 U.S.C. 154(b) by 11 days.

(21) Appl. No.: 10/760,354

(22) Filed: Jan. 21, 2004

(65) Prior Publication Data

US 2004/0164493 A1 Aug. 26, 2004

Related U.S. Application Data

(63) Continuation of application No. 10/229,103, filed on Aug. 28, 2002, now abandoned.
(60) Provisional application No. 60/342,244, filed on Dec. 27, 2001.

(51) Int. Cl.
*A63F 1/00* (2006.01)

(52) U.S. Cl. ..... 273/304; 273/306; 273/302; 273/308; 273/292

(58) Field of Classification Search ..... 273/292, 273/302, 304, 306, 308, 300, 301, 303
See application file for complete search history.

(56) References Cited

U.S. PATENT DOCUMENTS 1,273,864 A * 7/1918 Johnson ..... 273/307
4,437,670 A 3/1984 Simon
5,201,525 A 4/1993 Castro
5,863,040 A 1/1999 Van Hass
6,142,475 A 11/2000 Hennessey
6,247,697 B1 6/2001 Jewett

OTHER PUBLICATIONS

The Way To Play, by the Diagram Group, "Happy Families", "Authors", Paddington Press, Ltd., 1975, pp. 308–309.*
www.pagat.com/quartet/gofish.html, "Go Fish, Authors, Happy Families, Quartet", John McLeod, 1996.*
www.unclesgames.com, "Authors Card Game", US Games Systems Inc., 2003.*
Scarne's Encyclopedia of Games pp. 44, 45, 362, 363.

* cited by examiner

*Primary Examiner*—Benjamin H. Layno

(57) ABSTRACT

A method for an interactive exchange qualification card game designed to encourage social interaction among all players in a group. Any reasonable number of players may participate in the game. In the first mode of play, each player begins with a predetermined number of like symbol cards, such as World Landmark Theme cards, and collects the same number of different cards from the other players by the means of the exchange of cards. All players with appropriate collections at the end of the game qualify for a reward as determined by a game controller. If the number of rewards is limited and all players do not get a reward, secretly coded cards are selected, and player with the secret cards and the appropriate collection qualify for a reward as determined by the game controller. Further, there is another mode of play disclosed.

2 Claims, 9 Drawing Sheets

FLOW DIAGRAM

START OF GAME
FIRST MODE OF PLAY

EXCHANGE OF NEEDED CARDS:
PLAYERS 1 AND 2
FIRST MODE OF PLAY

EXCHANGE OF NEEDED CARDS:
PLAYERS 1 AND 3
FIRST MODE OF PLAY

END OF EXCHANGE
FIRST MODE OF PLAY

REWARD PRESENTATION
FIRST MODE OF PLAY

REWARD PRESENTATION:
SECRET CARD * SELECTION IN
OPTIONAL EXTENDED GAME
FIRST MODE OF PLAY

FLOW DIAGRAM

INTERACTIVE EXCHANGE QUALIFICATION GAME

CROSS REFERENCE TO A RELATED APPLICATION

This application claims the benefit of U.S. Provisional Application No. 60/342,244; Dec. 27, 2001. This application is a continuation of U.S. patent application Ser. No. 10/229,103; Aug. 28, 2002 now abandoned.

The present invention relates to an interactive exchange qualification card game (also referred to herein as IEQG).

BACKGROUND OF THE INVENTION

1. Field of the Invention

The present invention relates to an interactive exchange qualification card game where the object is to exchange certain cards to complete a predefined collection and thereby qualify for a reward or privilege, or optionally to extend the game by using certain of the cards which are secretly coded to qualify for a special reward or privilege as determined by a game controller. An example of the field of invention is an event where T-shirts are given as prizes. Without the game, T-shirts would be given to everyone who attends the event. With the game, everyone interacts, collects the appropriate cards and hands in the collection to receive a T-shirt.

2. Description of the Related Art

U.S. Pat. No. 4,437,670 to Simon has players bidding for cards with tokens. U.S. Pat. No. 5,201,525 to Castro converts trading cards into two sets of playing cards and players try to win cards from opponents. U.S. Pat. No. 5,863,040 to Van Gass uses abstract markings on cards and players must select non-matching pairs according to certain rules. U.S. Pat. No. 6,142,475 to Hennessey suggests 3 to 6 players and recites that larger groups require additional decks with no insight regarding the upper limit of players. Players in this game adopt fictitious roles, select from four piles of value-set cards and play for points.

Further, the following prior art has been noted. U.S. Pat. No. 6,247,697 to Jewett describes a melding card game with the following characteristics: 2 to 4 players; fixed images on the face of cards comparable to suits in a standard playing card deck; assigned values to different card images; central card stack; face-up card functioning as the common discard pile; special effects cards not considered "wild" or "Joker" that may be traded; accumulation of points and optional "wild" cards. The mode of play is an accumulation of cards via a central deck, melding and trading in order to achieve the desired gin or poker-like combinations of cards. They can exchange cards with each other only if they have one of the limited number of certain special function cards. The major mode of play is interacting with the central deck and melding; card exchanges are a limited and minor feature. No cards are secretly coded.

Further, the following prior art has been noted; namely, a copy of several pages from Scarne's Encyclopedia of Games. In the game of Donkey (page 362) each player is dealt four cards and passes one card to his left. The card passing continues until one player achieves four like cards and that player grabs a chip from the center of the table. The game is limited to 13 players since a standard card deck is used and each player gets four cards. The only "interaction" is with the player on the left. Cards are passed and there is no inquiry as to which card one has and which is needed. Players win by a process of elimination since players drop out until only one player remains and is declared the winner.

So it is with the other games cited in the Encyclopedia mentioned above. Play is in order between players on the left or right and the action is similar to discarding or melding. Such action is passive since there is no interaction among the players regarding specific cards and needs.

(Note: Hereinafter in the application, the term "symbol(s)" means "symbol (s) or image(s)".

The IEQG is not a parlor game, such as those played with standard playing card or special-purpose decks, or those using boards which also may involve one or more of the following: dice, spinners, tokens and special function cards. Any of these games may also involve points, chips or betting as an activity.

The IEQG is a social event game among all players in a group that may be very large, and not just between players on the right or left. It has a simple premise—the exchange of cards. It has a defined goal, collecting all like or all different-image cards. All players receive a reward or only a few players receive rewards via specially coded cards. There is no betting, no point values, no multiple card combinations similar to gin or poker, no suits, no tables, no common deck and no melding. Each player exchanges only one card with any other player and then only if that player has a different (or like) card that can be exchanged, i.e. cards that both players need. If either player does not need a particular card, there is no exchange. The social aspect of the game is achieved even if there is no exchange of cards between two players and the interaction has occurred. Games like poker and gin occur without any exchange of words relevant to the game. Conversation or banter in these cases can actually interfere with the manner of play and therefore such games may actually be/considered anti-social.

The Interactive Exchange Qualification Game is unique and quite different in a number of ways. The symbol on the face of the card—and cards are not the only means of play—has no value; there are no symbols that function as suits; there is no central resource deck; and no melding activities. Players with all like symbol cards exchange cards with other players to achieve all different symbol cards in order to "win" or qualify for a reward. Specially coded cards can be used if the number of rewards is less than the number of players involved in the game. A game controller sets up the cards, distributes them to the players and determines the rules for reward qualification.

The game may be played by any number of players, as determined by the game controller, and the number can be very large; all players play the game at the same time, rather than sequentially; the number of actively-played cards can be varied according to the amount of interaction desired by the game controller (the larger the number of cards to collect, the greater the level of interaction among members of the group), and the number and value of the rewards can vary according to the resources of the game controller.

None of the above inventions and patents, taken singly or in combination, are seen to describe the instant invention as claimed.

BRIEF SUMMARY OF THE INVENTION

An object of the present invention is to provide a method for an interactive exchange qualification card game that is designed to encourage social interaction among all players in a group. Any reasonable number of players may participate in the game. In the first preferred embodiment or mode of play, each player begins with a predetermined number of like cards or like symbol cards and collects the same number of different symbol cards from the other players by means of an exchange of cards. All players with appropriate collections at the end of the game qualify for a reward as determined by a game controller. If the number of rewards is limited, and all players do not get a reward, secretly coded cards are selected, and players with the secret cards and the appropriate collection qualify for a reward as determined by the game controller.

As desired herein, the word "symbol" is defined to mean a picture, image, design, word or phrase or any combination thereof. Likewise, the phrase "like symbol cards" or "like cards" is considered to be a group of cards having pictures, images, designs, words or phrases or any combination thereof. For example, if the IEQG were using a U.S. Presidents Theme Deck, players would start out with all Washingtons, or all Lincolns, or all Jeffersons and so on. At the end of the game each successful player would have one Washington, one Lincoln, one Jefferson and so on with the same number of different cards as when the player started the game. The cards that are considered "different" are cards that have a symbol or image thereon that are not like the one in the initial collection. The secretly coded cards are considered the primary feature of the Game and this is noted with an asterisk (*) in the text and the drawings. The picture, image, symbol, design, word or phrase that appear on the face and/or back of the cards are varied slightly by adding, deleting or changing some aspect of the appearance of the picture, image and so on, so that it is different or distinct but not obvious, and therefore "secret". A unique coding scheme can also be used. For example, cards can have numbers around the border and the position or sequence of certain numbers can constitute the secret coding. Another secret coding scheme could have different color boxes around the border and the position or sequence of certain color boxes can constitute the secret coding. Other secret coding methods can and may be employed.

The secretly coded cards can be listed on an insert with the game and the game controller can select the ones to use from the list. Alternately, a separate set of secret code identifier cards can be included with the Game and placed into a container or bowl for someone—the game controller, a player with an incomplete collection, a non-player and so on—would select the cards from the container and announce the secret codes. Players would examine their cards and identify if their specific card was the one selected.

The game controller defines the game, establishes the rewards and distributes the cards. The game controller also mediates such things as method for selecting the secret cards and treatment of incomplete collections. The game controller can be a player. All players are subject to the same probabilities and exchange dynamics as all other players. The game controller does not have any special advantage in the play of the game by virtue of being the controller.

If a player has an incomplete collection at the end of the exchange phase of the game, the game controller determines the qualification of the player to receive a reward and the type of reward the player is to receive. In the second embodiment or mode of play, each player begins with a predetermined number of different cards and collects the same number of like cards from the other players by means of an exchange of cards. The game controller is required to specify which particular card each player may collect when the playing cards are initially distributed, otherwise multiple players may decide to collect the same, thereby competing, cards. The use of secretly coded cards and the manner of winning are the same as in the first embodiment or mode.

Accordingly, there are three ways to qualify for rewards or privileges: (1) everyone with the complete collection of appropriate cards may win; (2) only those with a complete collection of appropriate cards and the secretly coded card may win; and (3) a player with an incomplete collection and a secretly coded card may also qualify for a prize as determined by the game controller.

DETAILED DESCRIPTION OF THE INVENTION

In its current embodiment, the Game consists of 40 sets of 20 different, easily recognizable cards with a World Landmark theme including images of the Eiffel Tower, Great Pyramids, Great Wall of China, Statue of Liberty, Easter Island, Mt. Everest, London Bridge, Mt. Rushmore, Taj Majal, Leaning Tower of Pisa, Matterhorn, Roman Colosseum, Arc de Triomphe, Big Ben, White House, Sphix, Neuschwanstein Castle, Stonehenge, Windmills, and Chichen Itza.

Figure 1:
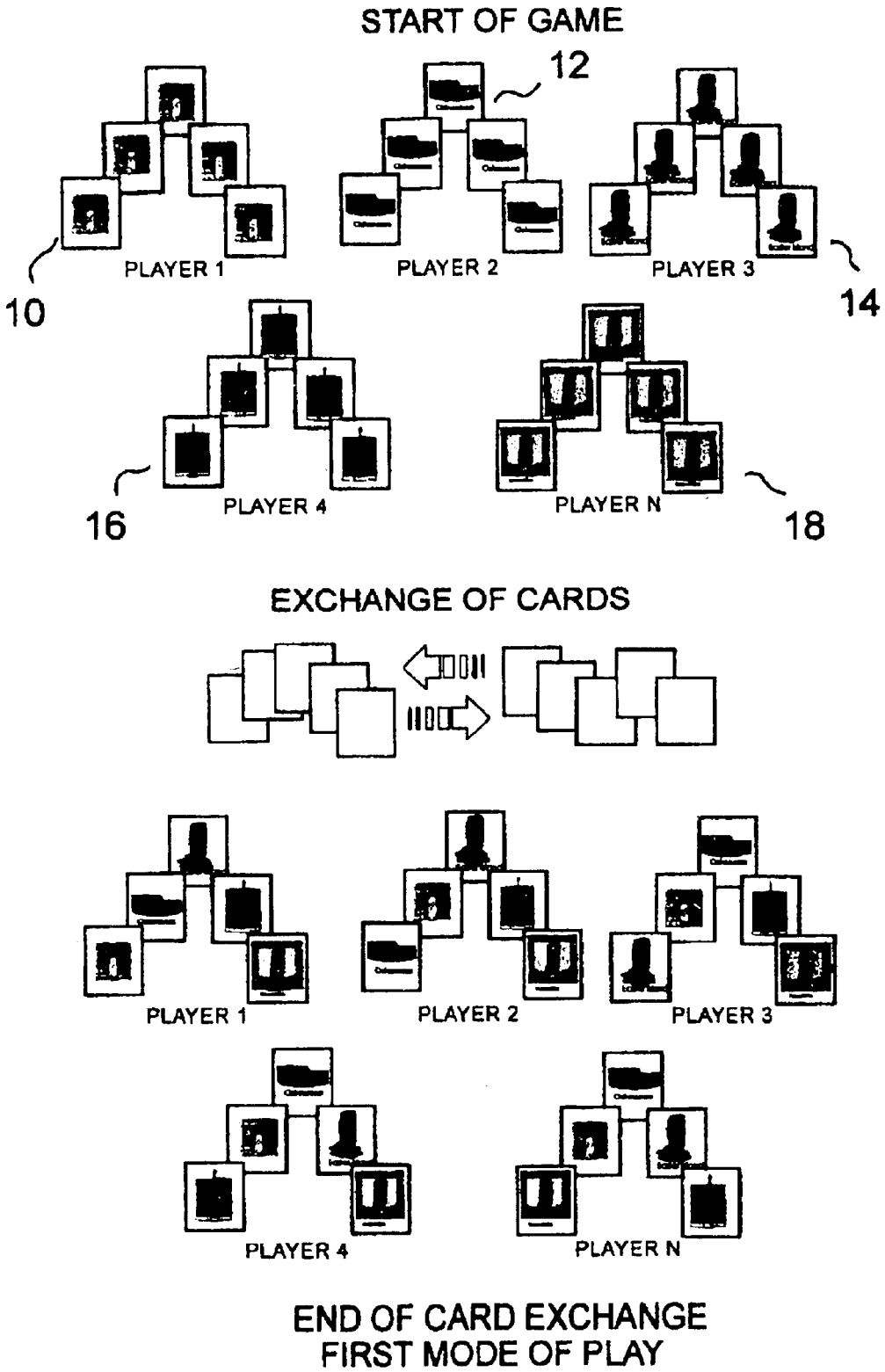
FIG. 1 is an illustration of the overview of the game in accordance with the first mode of play as defined by the present invention and includes the EXCHANGE OF CARDS.

FIG. 1 is an illustration of the overview of the game in accordance with the first mode of play as defined by the present invention. PLAYERs 1, 2, 3, 4, and "N" hold five like World Landmark theme cards with an image of the Arc de Triomphe 10, the Roman Colosseum 12, Easter Island 14, the Eiffel Tower 16 and the Leaning Tower of Pisa 18, respectively. "N" PLAYERS denotes any number of additional players as determined by the game controller. The exchange of cards between players takes place. The end of the card exchange occurs when each player has five, which is the required number in this illustration, of different World Landmark theme cards as listed above.

Figure 2:
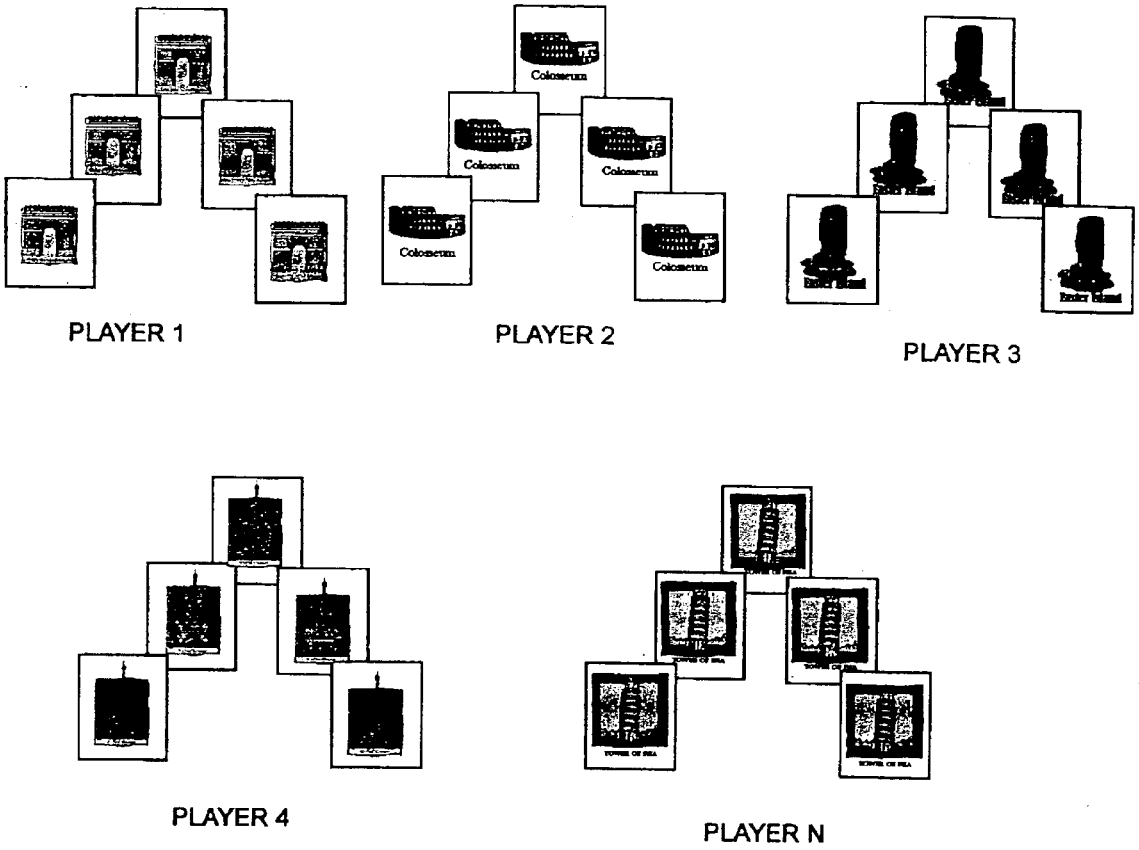
FIG. 2 is a representation of the card objects at the start or the beginning of the game.

FIG.2 is a representation of the card objects at the start or the beginning of the game, in accordance with the first mode of play. PLAYERs 1, 2, 3, 4, and "N" hold five like image or symbol cards with a World Landmark theme, namely the Arc de Triomphe, the Roman Colosseum, Easter Island, the Eiffel Tower and the Leaning Tower of Pisa, respectively.

Figure 3:
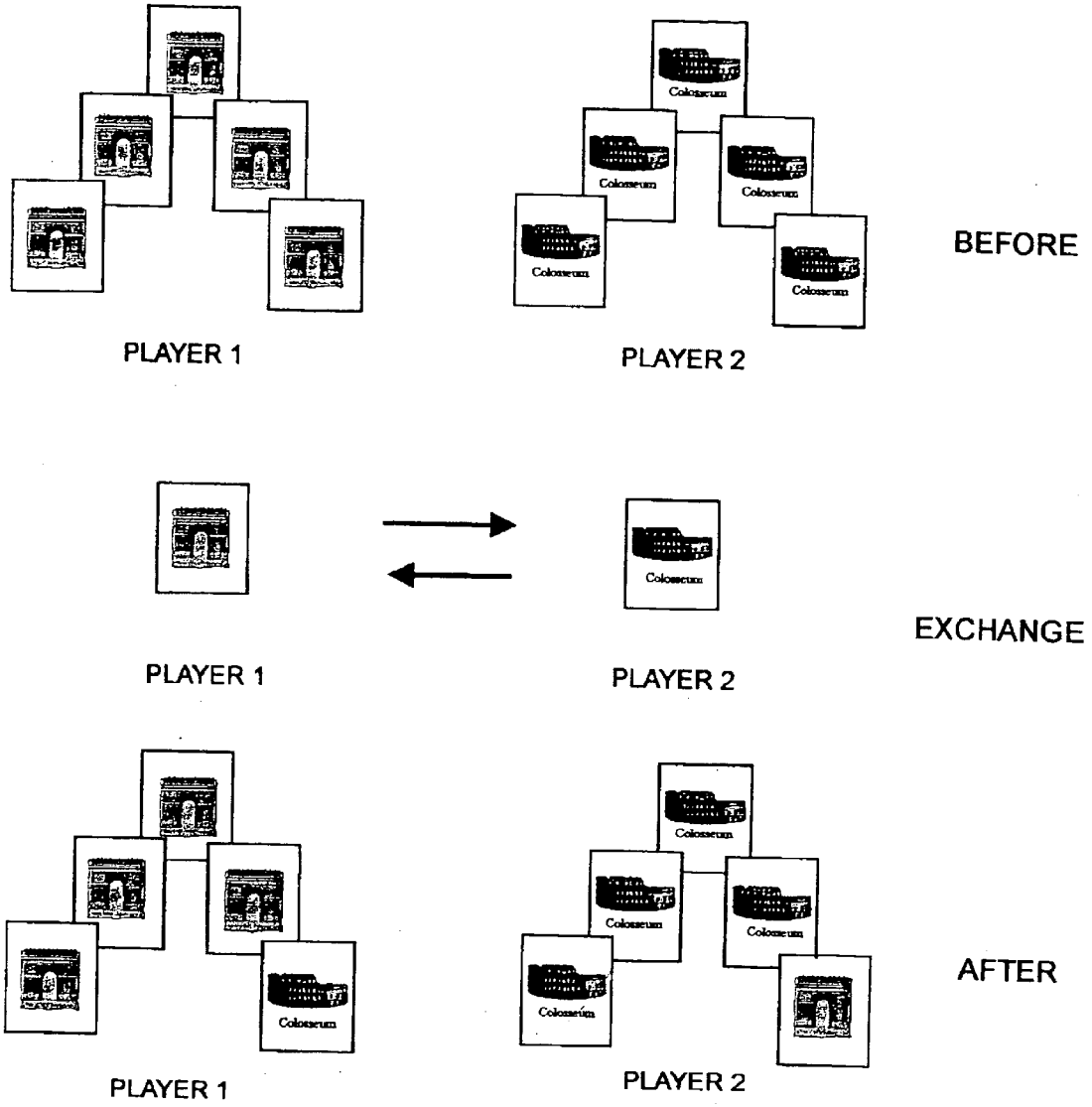
FIG. 3 is an illustration of the exchange of needed cards between PLAYERS 1 and 2.

FIG.3 is an illustration of the exchange of needed cards between PLAYERs 1 and 2. In the BEFORE phase, PLAYERs 1 and 2 hold like exchange one of the Arc de Triomphe and the Roman Colosseum cards with each other. In the AFTER phase, PLAYERs 1 and 2 hold 4 like image or symbol cards and 1 different image or symbol card as a result of the card exchange.

Figure 4:
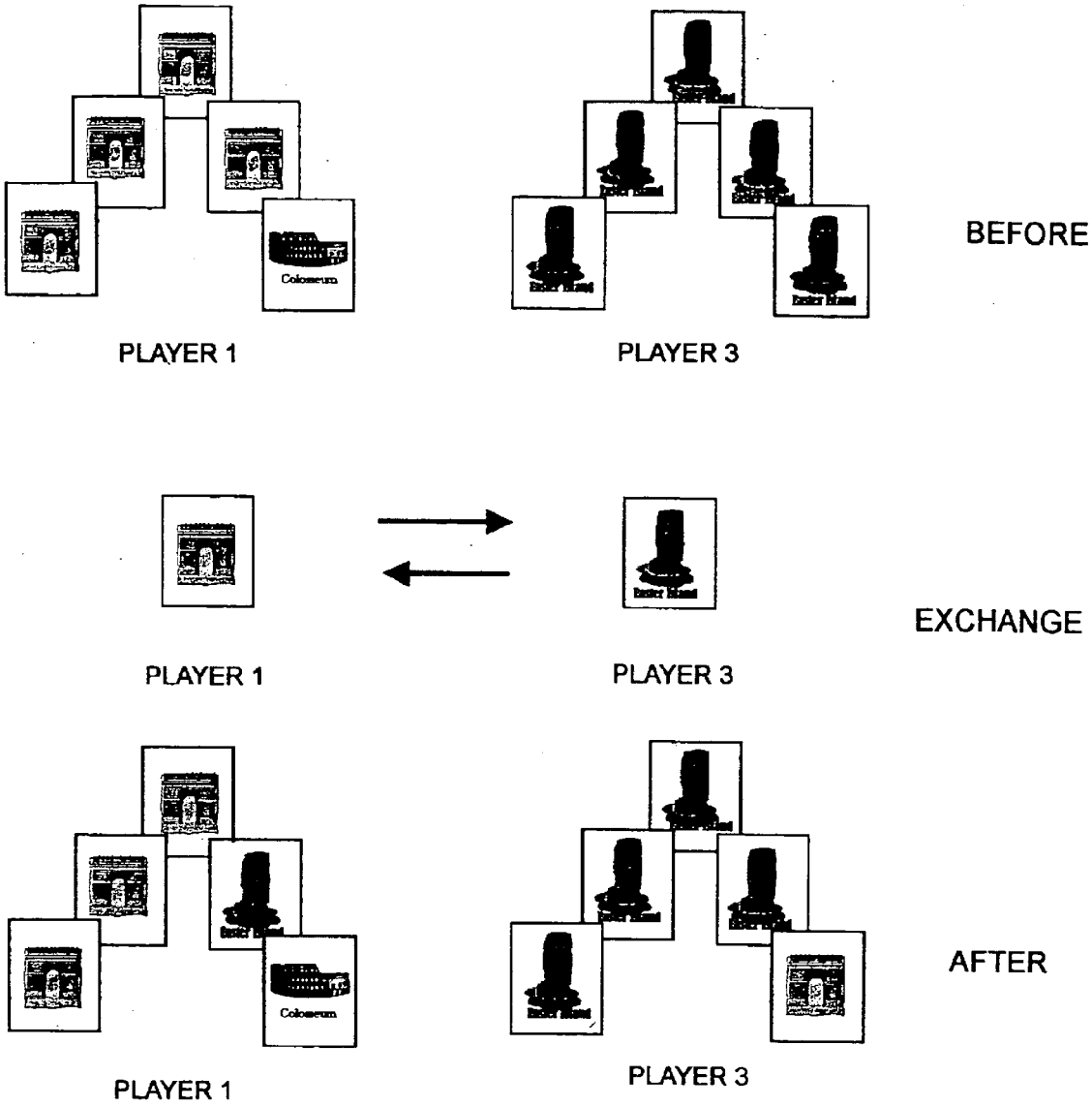
FIG. 4 is an illustration of the exchange of needed cards between PLAYERS 1 and 3.

FIG.4 is an illustration of the exchange of needed cards between PLAYERs 1 and 3. In the BEFORE phase, PLAYER 1 holds 4 cards with the image or symbol of the Arc de Triomphe and 1 card with the image or symbol of the Roman Colosseum that this player received from a previous exchange; and PLAYER 3 holds 5 like cards with the image or symbol of Easter Island. In the EXCHANGE phase, the PLAYERs exchange one of the Arc de Triomphe and the Easter Island cards with each other. In the AFTER phase, PLAYER 1 holds 3 like cards with the image or symbol of the Arc de Triomphe and 1 card with the Roman Colosseum and 1 card with Easter Island; and PLAYER 3 holds 4 like image or symbol cards and 1 different image or symbol cards as a result of the card exchange.

Figure 5:
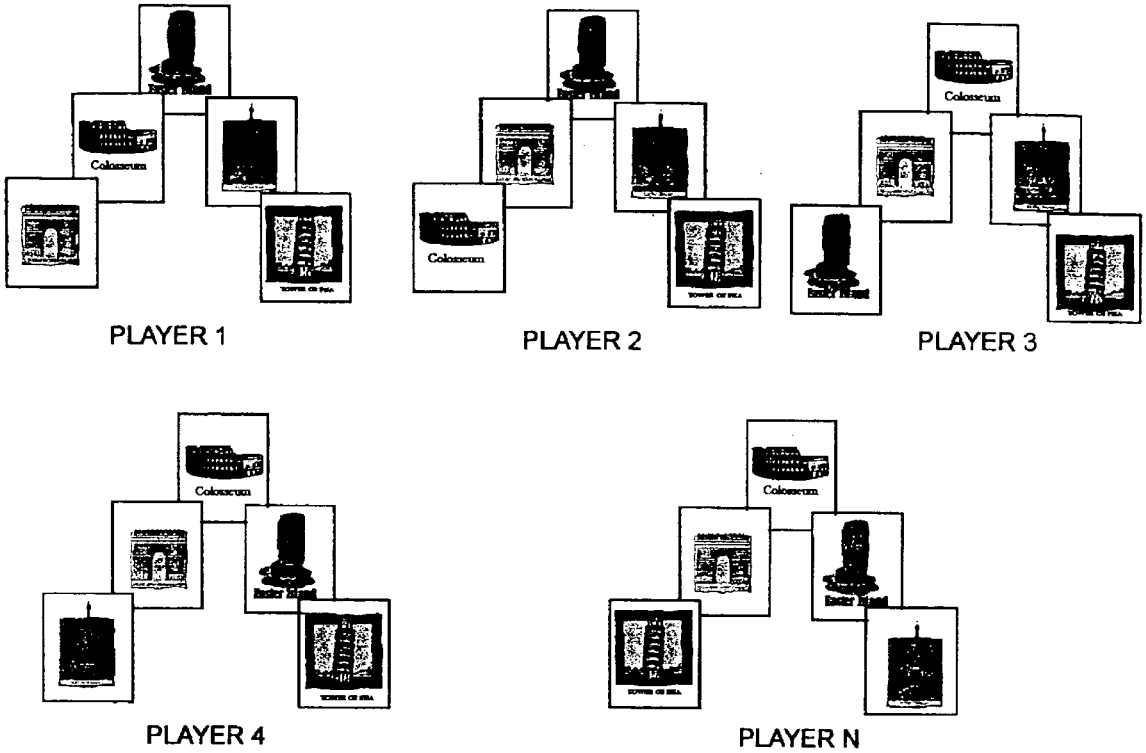
FIG. 5 is a representation of the card objects at the end of the exchange process of the first mode of play.

FIG. 5 a representation of the card objects at the end of the exchange process of the first mode of play. In this mode, each player begins with a predetermined number of cards bearing the same distinctive image or symbol which is different from the image or symbol in the other players' collections. Each player exchanges cards so that at the end of the exchange process each player has the same number of cards as at the start of the game but each card bears a different image or symbol collected from the other players.

Figure 6:
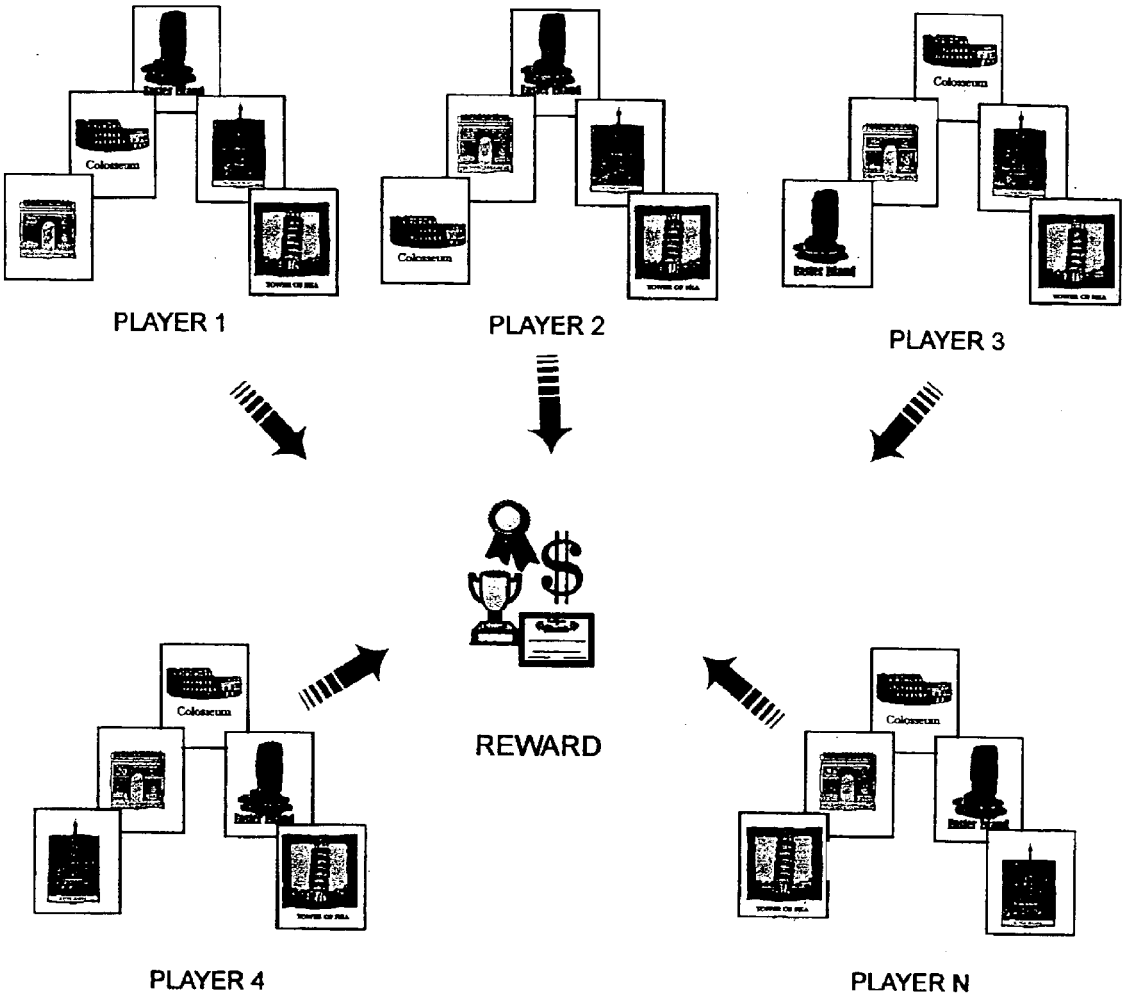
FIG. 6 is a representation of the card objects for a reward presentation at the end of the first mode of play.

FIG. 6 is a representation of the card objects for a reward presentation at the end of the first mode of play. Each hand of the players is respectively shown holding a like image or symbol collection. All of the players qualify for a "REWARD" as determined and awarded by the game controller.

Figure 7:
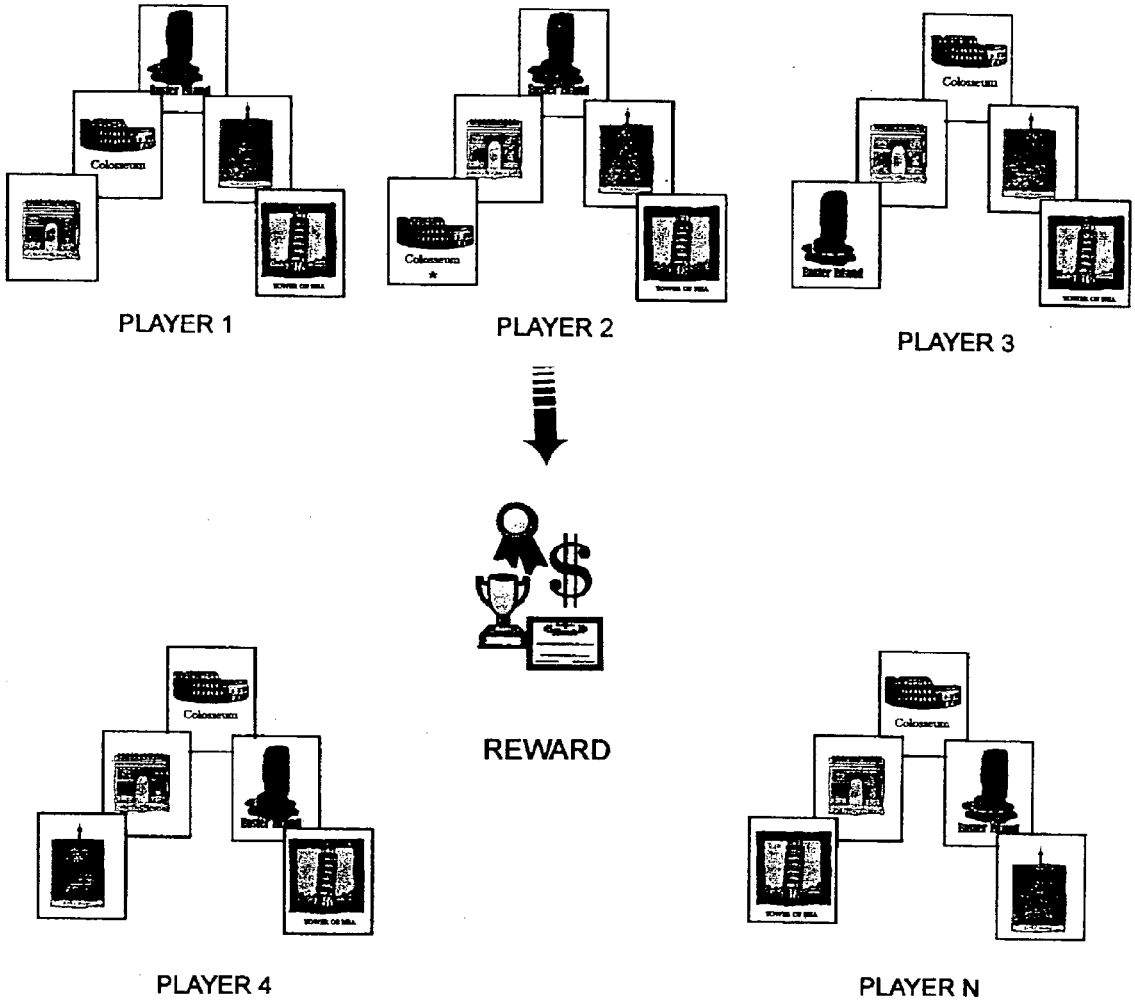
FIG. 7 is a representation of the card object having a secret code for a reward presentation at the end of the optional extended phase of the first mode of play.

FIG. 7 is a representation of the card object having a secret code for a reward presentation at the end of the optional extended phase of the first mode of play. As part of the game, one or more cards in each like image or symbol set contains a secret code that is used in the optional extended game. As shown in FIG. 7, this secret code is depicted as an * (asterisk). In this phase, the player or players with the appropriate collection and the secretly coded card selected in a manner determined by the game controller qualifies for a "special" reward. Thus, this phase constitutes an optional continuation of play of the first mode with the addition of the secretly coded cards. Specifically, PLAYER 2 is shown holding the secretly coded Roman Colosseum * card. PLAYER 2 is entitled to receive the Reward from the game controller.

The secretly coded cards can be listed on an insert with the game and the game controller can select the ones to use from the list. Alternately, a separate set of secret code identifier cards may be included with the Game and placed into a container or bowl for someone, such as the game controller, a player with an incomplete collection, or a non-player would select the cards from the container and announce the secret codes. Players would examine their cards and identify if their specific card was the one selected.

Figure 8:
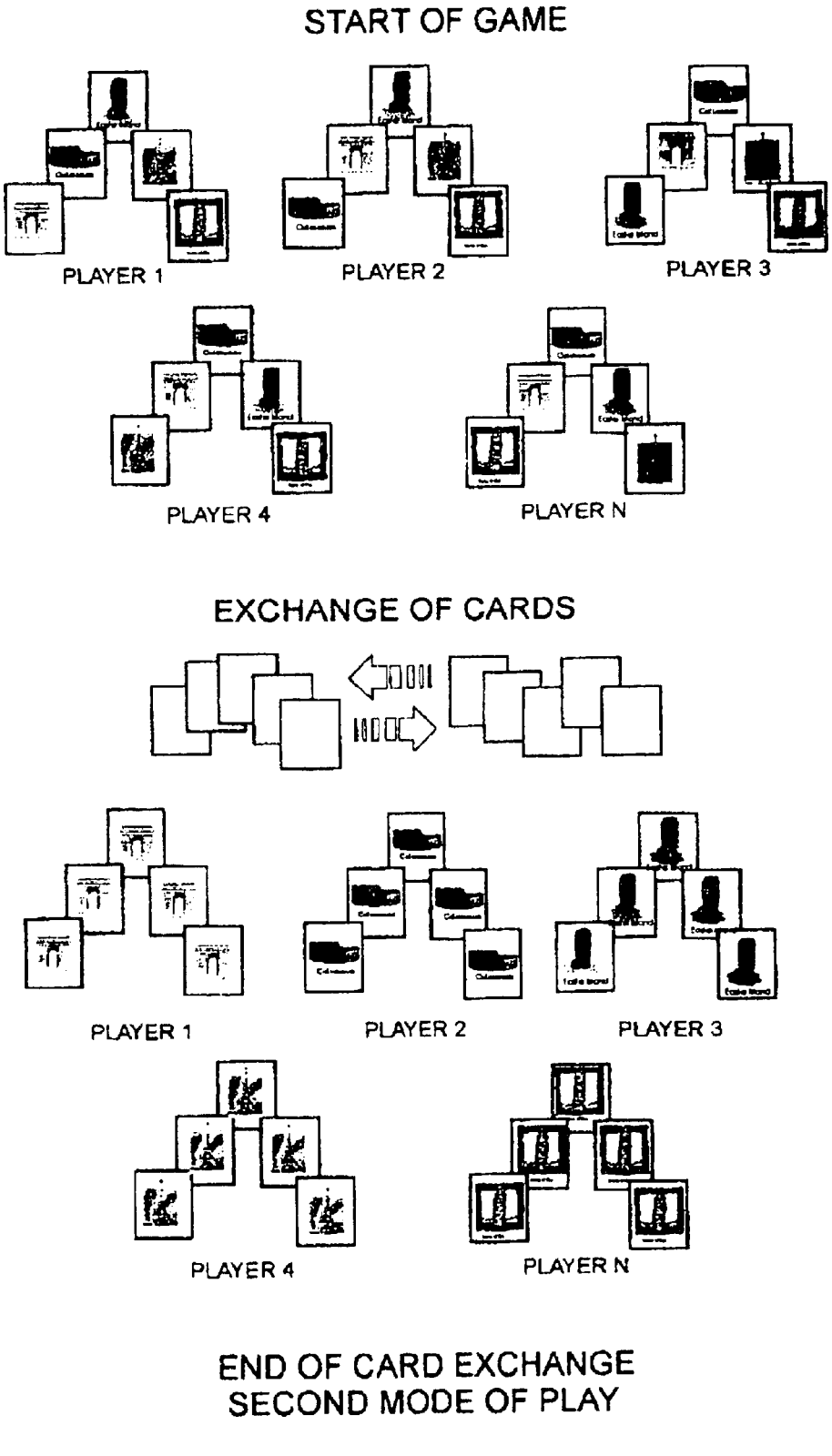
FIG. 8 is an overview of the game in accordance with the second mode of play as defined by the present invention.

FIG. 8 is an overview of the game in accordance with the second mode of play as defined by the present invention. PLAYERs 1, 2, 3, 4 and "N" hold five different World Landmark theme cards with an image of the Arc de Triomphe, the Roman Colosseum, Easter Island, the Eiffel Tower and the Leaning Tower of Pisa, respectively. The exchange of cards between players takes place. The end of the card exchange occurs when each player has five, which is the required number in this illustration, of the same World Landmark theme cards as listed above. Each player collects the required number of same image or symbol cards as determined by the game controller.

Figure 9:
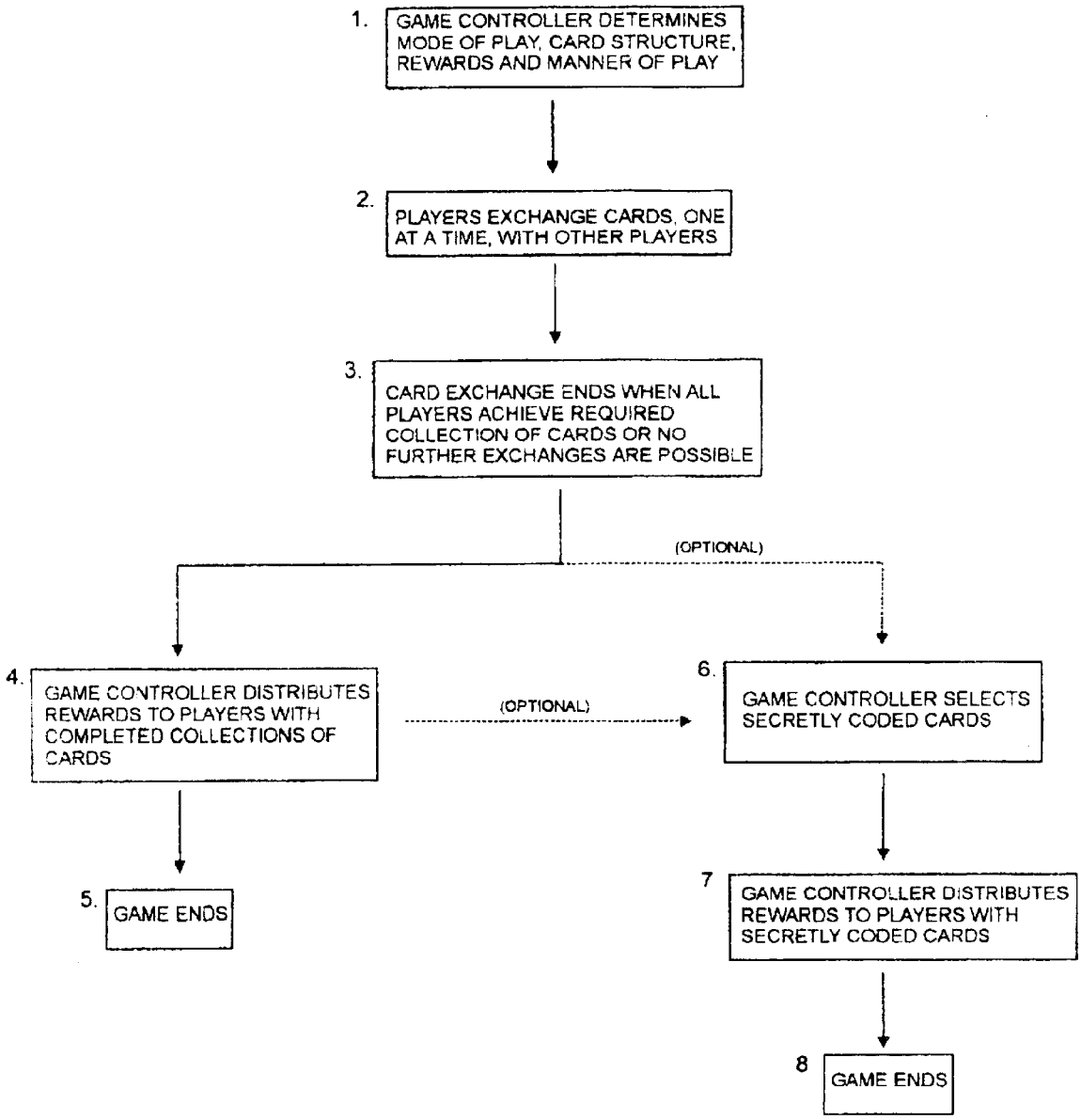
FIG. 9 is a flow chart showing the major steps in the game.

FIG. 9 is a flow chart showing the major steps in the game. In the first step, the game controller determines the mode of play, card structure, rewards and manner of play. Players then exchange cards, one at a time, with the other players in Step 2. Step 3 is the end of the exchange process when all players achieve the required collection or no further exchanges are possible. Step 4 involves the distribution of rewards to players with the completed collection of cards and the end of the game as Step 5. Step 6 is an optional continuation of the game with the game controller selecting secretly coded cards and in Step 7 distributing additional special rewards to players having those cards. The game then ends as shown in Step 8. The optional Step 6 can occur in addition to or in place of Step 4.

Other number combinations such as, but not limited to, 20 sets of 20 cards or 50 sets of 25 cards are also included in the spirit and scope of the invention. The spirit and scope of the Game may also involve other themes such as, but not limited to, U.S. Presidents, Flowers, Birds, Lighthouses, Sports, Modes of Transportation, World Countries or U.S. Cities and States.

Accordingly, the present invention constitutes a method for playing an interactive exchange qualification card game in which any reasonable number of players may participate, that comprises the following steps:

(1) in the first mode of play:

(a) each player begins with a predetermined number of like symbol cards and collects the same number of different cards from the other players by means of an exchange of cards;

(b) all players with appropriate collections at the end of the game qualify for a reward as determined by a game controller;

(c) if the number of rewards is limited, and all players do not get a reward, secretly coded cards are then selected, and players with the secret cards and the appropriate collection qualify for a reward as determined by the game controller;

(d) if a player has an incomplete collection at the end of the exchange phase of the game, the game controller determines the qualification of the player to receive a reward and the type of reward the player is to receive;

(2) in the second mode of play:

(a) each player begins with a predetermined number of different cards and collects the same number of like symbol cards from the other players by means of an exchange of cards;

(b) the game controller is required to specify which particular card each player may collect when the playing cards are initially distributed, otherwise multiple players may decide to collect the same, thereby competing, cards;

(c) the use of secretly coded cards and the manner of winning are the same as in the first mode. There are three ways to qualify for rewards or privileges: (1) everyone with the complete collection of appropriate cards may win (2) only those with a complete collection of appropriate cards and the secretly coded card may win as determined by the game controller; and (3) a player with an incomplete collection and a secretly coded card may also qualify for a prize as determined by the game controller.

In summary, the present invention provides two modes for playing an interactive exchange qualification game.

In the first mode: start same/collect different

In the second mode: start different/collect same

In both modes the game has two pathways to a reward.

In the first pathway: appropriate collection/receive reward

In the second pathway: appropriate collection/secret card/receive reward

If everyone is to receive a reward, the first pathway is used, as in the case of the T-shirt handout, a popular promotion gimmick. If only a limited number of rewards are available, the optional pathway is used.

It is possible for all cards to be secretly coded to foil any attempts to hoard prize cards by repeat players (for example, at a social club).

Depending on the number of players, there may not be a "clean" number of exchanges. Everyone may not be able to complete a collection because of an odd number of players or some players may drop out of the game, but the secret cards are still in play. In such cases, the game controller decides what will happen. The object of the game is to get the complete collection of cards; if a player cannot do that for any reason, the game allows for consolation prizes. The game is flexible and the game controller has a number of options to exercise depending on the situation.

Further, the present invention constitutes an interactive exchange qualification card game combination of the above steps. Large groups of people attending an event generally do so without any direct social interaction with each other. In order to encourage personal interaction, this invention provides a means for individuals to converse with each other in order to collect cards; for example, collect different pictures or phrases on one side making up a predefined collection, which is revealed to all players at the start. A complete collection can then qualify the holder to receive an announced reward such as a prize, gift, discount, privilege or premium item. The front or back of one or more cards can be secretly coded or marked as qualifying for a special reward. The game is particularly designed to encourage social interaction among all players in a group.

In addition to above description of method of the IEQG according to the present invention, there is the following description of a kit of the IEQG according to the present invention.

The kit would have:

(a) 40 sets of 20 different cards with a World Landmarks theme (b) Secretly coded cards and a set of secret card identifiers (c) A set of reusable plastic pouches to hold the player packs (d) Playing instructions The cards would be further subdivided and bound together in 40 packs of each of the 20 different image or symbol cards. For example, 40 cards of the Eiffel Tower would be bound together in one pack, 40 cards of the London Bridge would be bound together in another pack, and so on until all 20 of the different World Landmark cards would be packaged together to make up the game package, apparatus or kit.

The basic set of cards could be reused many times. If only 20 sets were used, say for a birthday party of 20 guests and only 10 of the 20 different cards were in the required collection, the cards could easily be reused. If the entire 40 sets were used and all 20 different cards were in the collection, it would be up to the game controller to reconstitute the 800 cards into sets for reuse. It could be used once and the players allowed to take their collected cards with them and the remnants trashed.

The game could involve a hundred players, for example, such as in a wedding party, consisting of 50 bride guests and 50 groom guests. The "game controller" which could be the bride, groom, bride's mother, or best man and so on would determine the number of cards in the collection. Five cards can be collected readily; 10 cards take a bit longer. Collecting 10 cards might define the level of interaction the game controller desires. The backs of the playing cards would be a different color for bride and groom family/friends. Start out with one color and finish with the other. Prizes could be CD's, flower arrangements from the wedding, first dance with the bride/groom, bottle of champagne, or a combination thereof plus others depending on the financial resources or creativity of the game controller.

If there are 100 players with 40 bride guests and 60 groom guests, then 20 groom guests would need to "sit out" e.g. husbands or wives of players) or certain spouses or guests would play as teams rather than individuals. This would be decided by the game controller.

The game could also be used for social clubs. A VIP section of 50 guys and 50 gals would be designated for the game and cards distributed by the club manager. One color for the guys; another color for the gals. Exchange would only be allowed between cards of the opposite color.

The game would also be used for adult or kids' birthday parties.

The game cards may include, for example, cartoon characters or racing cars, and tell the party guests that they will get a reward for collecting the required cards and listen to them cheer. Give everyone a prize such as a Hot Wheels car for a completed set and give out 5 CD's through secretly coded cards. Let everyone take home the cards and prizes they collected.

The game has been described as using playing cards, but the substitution of other objects/items for the cards are within the scope of the invention.

In conclusion, the present invention provides a method of playing an interactive exchange qualification card game, in which any reasonable numbers of players may participate under the guidance of a game controller in accordance with a set of instructions and rules related thereto, and includes first and second modes of play and rewards for the players and comprises the following steps:

A. In the first mode of play;

(a) providing a deck of playing cards including:

(1) a predetermined number of cards displaying like symbols, the like symbols constituting a single world landmark theme, (2) A predetermined number of cards displaying symbols that are different from the like symbol cards, the different symbols constituting world landmark themes other than the single world landmark theme; and (3) A predetermined number of the like symbol cards and different symbols being secretly coded thereon;

(a) each player begins play with a predetermined number of cards, which may be like symbol cards or different symbol cards;

(b) then each player proceeds to collect the same number of cards from the other players by means of an exchange of cards;

(c) the first mode of play ends when all players accumulate their respective appropriate collections from the exchange of cards;

(d) wherein certain players having accumulated collections of entirely like symbol cards, which may or may not be secretly coded thereon, thereby qualifying for their respective rewards under the guidance of the game controller; and (e) wherein the remaining players having accumulated collections of both like symbol cards and different symbol cards, thereby qualifying for rewards as determined by the number of secretly coded cards held by the respective remaining players under the guidance of the game controller.

Further, the method steps comprise a second mode of play wherein:

B. In the second mode of play, (a) the game controller may designate which particular card each player may collect when the cards are initially distributed, otherwise multiple players may independently decide to collect the same, thereby competing cards;

(b) each player begins play with a predetermined number of like symbol cards;

(c) then each player proceeds to collect the same number of different symbol cards from the other players by means of an exchange of cards;

(d) the second mode of play ends when all players accumulate their respective appropriate collections from the exchange of cards;

(e) wherein certain players having accumulated collections of entirely like symbol cards, which may or may not be secretly coded thereon, thereby qualifying for their respective rewards under the guidance of the game controller; and (f) wherein the remaining players having accumulated collections of both like symbol cards and different symbol cards, thereby qualifying for rewards as determined by the number of cards, being secretly coded thereon under the guidance of the game controller.

While it has been shown and described several embodiment or modes of the present invention, it is to be understood that it is subject to many modifications without departing from the spirit and scope of the claims.

What is claimed is:

1. A method of playing an interactive exchange qualification card game, in which any reasonable numbers of players may participate under the guidance of a game controller in accordance with a set of instructions and rules related thereto, and includes first and second modes of play and rewards for the players, comprising the following steps:

A. In the first mode of play;

(a) providing a deck of playing cards including:

(1) a predetermined number of cards displaying like symbols, the like symbols constituting a single world landmark theme, (2) a predetermined number of cards displaying symbols that are different from the like symbol cards, the different symbols constituting world landmark themes other than the single world landmark theme; and (3) a predetermined number of like symbol cards and different symbol cards being secretly coded with a secret code identifier thereon unknown to the players;

(a) each player begins play with a predetermined number of cards, which may be like symbol cards or different symbol cards;

(b) then each player proceeds to collect the same number of cards from the other players by means of an exchange of cards;

(c) the first mode of play ends when all players accumulate their respective appropriate collections from the exchange of cards;

(d) wherein certain players having accumulated collections of entirely like symbol cards, which may or may not be secretly coded thereon, thereby qualifying for their respective rewards under the guidance of the game controller; and (e) wherein the remaining players having accumulated collections of both like symbol cards and different symbol cards, the game controller announcing the secret code, and the remaining players examining their cards for the secret code, thereby qualifying for rewards as determined by the number of secretly coded cards held by the respective remaining players under the guidance of the game controller.

2. A method according to claim 1 and includes a second mode of play wherein:

A. In the second mode of play, (a) the game controller may designate which particular card each player may collect when the cards are initially distributed, otherwise multiple players may independently decide to collect the same, thereby competing cards;

(b) each player begins play with a predetermined number of like symbol cards;

(c) then each player proceeds to collect the same number of different symbol cards from the other players by means of an exchange of cards;

(d) the second mode of play ends when all players accumulate their respective appropriate collections from the exchange of cards;

(e) wherein certain players having accumulated collections of entirely like symbol cards, which may or may not be secretly coded thereon, thereby qualifying for their respective rewards under the guidance of the game controller; and (f) wherein the remaining players having accumulated collections of both like symbol cards and different symbol cards, the game controller announcing the secret code, and the remaining players examining their cards for the secret code, thereby qualifying for rewards as determined by the number of secretly coded cards held by the respective remaining players under the guidance of the game controller.

* * * * *